US011199065B2

(12) United States Patent
van Petegem

(10) Patent No.: US 11,199,065 B2
(45) Date of Patent: Dec. 14, 2021

(54) LATCH MECHANISM AND SYSTEM FOR DOWNHOLE APPLICATIONS

(71) Applicant: Ronald van Petegem, Montgomery, TX (US)

(72) Inventor: Ronald van Petegem, Montgomery, TX (US)

( * ) Notice: Subject to any disclaimer, the term of this patent is extended or adjusted under 35 U.S.C. 154(b) by 136 days.

(21) Appl. No.: 16/538,827

(22) Filed: Aug. 13, 2019

(65) Prior Publication Data

US 2019/0360287 A1 Nov. 28, 2019

Related U.S. Application Data

(63) Continuation of application No. 15/330,974, filed on Jul. 11, 2017, now Pat. No. 10,428,608.

(60) Provisional application No. 62/476,738, filed on Mar. 25, 2017.

(51) Int. Cl.

| | |
|---|---|
| ***E21B 23/01*** | (2006.01) |
| ***E21B 23/02*** | (2006.01) |
| ***E21B 23/08*** | (2006.01) |
| ***E21B 23/12*** | (2006.01) |
| ***E21B 43/14*** | (2006.01) |
| *E21B 12/00* | (2006.01) |

(52) U.S. Cl.

CPC ..... *E21B 23/12* (2020.05); *E21B 23/01* (2013.01); *E21B 23/02* (2013.01); *E21B 23/08* (2013.01); *E21B 43/14* (2013.01); *E21B 12/00* (2013.01)

(58) Field of Classification Search

CPC ..... E21B 23/12; E21B 23/08; E21B 23/01; E21B 23/02

See application file for complete search history.

(56) References Cited

U.S. PATENT DOCUMENTS

| | | | | |
|---|---|---|---|---|
| 2,380,022 A * | 7/1945 | Burt | E21B 33/146 | 166/214 |
| 2,862,564 A * | 12/1958 | Bostock | E21B 23/02 | 166/214 |
| 4,139,059 A * | 2/1979 | Carmichael | E21B 43/10 | 166/208 |
| 4,540,048 A * | 9/1985 | Gazda | E21B 23/02 | 166/214 |
| 4,569,404 A * | 2/1986 | Milberger | E21B 33/043 | 166/208 |
| 4,730,851 A * | 3/1988 | Watts | E21B 43/10 | 285/123.4 |
| 4,896,721 A * | 1/1990 | Welch | E21B 23/02 | 166/214 |

(Continued)

*Primary Examiner* — Blake Michener

(74) *Attorney, Agent, or Firm* — Compton & Associates PLLC; Matthew Compton

(57) ABSTRACT

A system and method for conveying a tool to a target sub within a tubular string having a number of subs. Each sub may include at least one ledge or shoulder in or on its interior surface that can be used as a latch stopper or stopper, for receiving and engagement with a latch. The subs may also have a latch deflector or deflector. In one embodiment, the latch deflector is a latch-deflection shoulder protruding into the internal diameter (ID) of the string for deflecting a latch, to be subsequently introduced, out of or into the latch-stopping shoulder. The distance between the latch stopper and the latch deflector, referred to as the "deflection radius," may be used as an address that uniquely identifies each sub, and can vary from sub to sub.

13 Claims, 10 Drawing Sheets

(56) References Cited

U.S. PATENT DOCUMENTS

| | | | | | |
|---|---|---|---|---|---|
| 5,579,829 | A * | 12/1996 | Comeau | E21B 23/02 | 166/117.6 |
| 6,199,632 | B1 * | 3/2001 | Shy | E21B 23/04 | 166/212 |
| 6,202,746 | B1 * | 3/2001 | Vandenberg | E21B 7/061 | 166/117.6 |
| 6,631,768 | B2 * | 10/2003 | Patel | E21B 17/1021 | 166/237 |
| 6,935,428 | B2 * | 8/2005 | McGlothen | E21B 23/01 | 166/313 |
| 7,325,617 | B2 * | 2/2008 | Murray | E21B 34/14 | 166/376 |
| 7,878,257 | B2 * | 2/2011 | Chen | E21B 34/14 | 166/386 |
| 8,393,402 | B2 * | 3/2013 | Saurer | E21B 41/0035 | 166/382 |
| 8,616,293 | B2 * | 12/2013 | Robertson | E21B 23/02 | 166/382 |
| 9,140,085 | B2 * | 9/2015 | Georgi | E21B 23/02 | |
| 9,416,609 | B2 * | 8/2016 | Robertson | E21B 43/123 | |
| 9,534,471 | B2 * | 1/2017 | Etzel | E21B 34/14 | |
| 9,739,117 | B2 * | 8/2017 | Campbell | E21B 34/14 | |
| 9,938,788 | B2 * | 4/2018 | Barbato | E21B 23/03 | |
| 10,428,608 | B2 * | 10/2019 | Petegem | E21B 23/08 | |
| 2004/0149452 | A1 * | 8/2004 | Pendleton | E21B 23/00 | 166/381 |
| 2014/0299319 | A1 * | 10/2014 | Pabon | E21B 41/00 | 166/285 |
| 2015/0184476 | A1 * | 7/2015 | Robertson | E21B 10/32 | 166/297 |
| 2016/0265294 | A1 * | 9/2016 | Robertson | E21B 23/02 | |

* cited by examiner

LATCH MECHANISM AND SYSTEM FOR DOWNHOLE APPLICATIONS

RELATED APPLICATIONS

This patent application claims priority to U.S. Provisional Application Ser. No. 62/476,738, filed 2017 Mar. 25, and is a continuation of co-pending U.S. Nonprovisional application Ser. No. 15/330,974 filed on 2017 Jul. 11, which is hereby incorporated by reference.

FIELD

This specification relates generally to oil well completions, and more particularly to a latch mechanism and system for conveying tools from surface to specified locations within a subterranean well for use in completion systems.

BACKGROUND

This invention relates to what is generally known as the completion of subterranean wells. Generally, such wells are created for producing hydrocarbons from a subterranean formation. As part of the overall process of producing hydrocarbons, in some cases, a subterranean formation can be treated or injected with fluids or slurries, including but not limited to water, steam, gas, acids, and sand slurries. More particularly, embodiments of the invention relate to a completion system for conveying tools that can aid with performing such treatments, and more generally that can aid with performing, production, stimulation, intervention, injection, or other operations related to the production of hydrocarbons at specific locations within a subterranean well. "Completion" is a generic term used to generally describe any action or treatment in a well, field, or reservoir to stimulate, enhance, improve, increase or decrease one or more of the following; flow or production performance, longevity of the flow or production performance, the total recoverable hydrocarbons, percentage of water produced; or percentage of gas produced. "Completion System" is a generic term used to generally describe any component or combination of components that perform any completion in one (1) or more zones, by diverting flow, splitting flow, directing flow, isolating one zone or interval from another zone or interval; and, stopping, starting, controlling or regulating flow in or out of any zone, production, stimulation, or injection operations. Tools may include, but are not limited to one or more of the following, plugs, darts, down hole pressure/temperature gauges, flow regulators, sliding sleeves, safety valves, check valves, perforating guns, shifting tools and packers for subdividing the well into different production zones. Operations may also include but are not limited to one or more of the following; positioning a down hole gauge, perforating or otherwise making one or more holes in a well tubular, opening or otherwise repositioning a down hole sliding sleeve, installing, activating or otherwise manipulating an artificial lift device, and installing a permanent or temporary plugging device which may contain a core that is in whole or in part meltable, degradable, disintegrable, removable or otherwise disappearing.

In a staged or zoned wellbore completion operation, a well is divided into multiple zones, also referred to as "stages" or "intervals." Each zone can be fluid-isolated and/or pressure isolated from other zones, in whole or in part, so it can be treated independently of other zones to resolve various conditions in that zone. Those skilled in the art will appreciate that in many situations where one is attempting to pressure-isolate or fluid-isolate one zone from another, though substantial isolation may be achieved, seepage of pressure or fluids across zones may nonetheless occur. Therefore, isolation, fluid-isolation, and pressure-isolation encompasses such situations, whether or not such seepage occurs.

In many subterranean wells, it is desirable to have portions of the well sub-divided in smaller zones, which means having a higher number of zones for a well of a given length. With reference to FIG. 1, an example of a wellbore completion system is shown, which can be used to effect treatment of a formation 10 through a wellbore 12. Treatment of a formation may include e.g., deploying stimulation fluids into the formation, injecting fluids sometimes above the fracture gradient away from the wellbore into the formation, and moving hydrocarbons from the formation to surface. The wellbore completion system referenced in FIG. 1 includes a tubing string 14, sometimes referenced as a liner, having an uphole end 14*b* extending toward surface and a downhole end 14*a*. The tubing string 14 comprises a plurality of spaced apart port subs 16*a* to 16*e* that each include one or more ports 17*a* to 17*e* opened through the tubing string wall to permit access between the tubing string inner bore 18 and the wellbore 12. A packer or other isolation device 20*a* is mounted between the upper-most port sub 16*a* and the surface, and further packers 20*b* to 20*f* are mounted between each pair of adjacent port subs. In some systems, there can be more than one packer between the port subs. The packers are each disposed about the tubing string 14, encircling it and positioned to seal the annulus between the tubing string 14 and the wellbore wall. Thus, fluid and/or pressure is significantly or completely prevented from passing through the annulus into adjacent zones, and the packers 20 thus divide the wellbore 12 into zones that are isolated from each other and that can be individually treated, produced or injected. A treatment can be applied to one or more zones in the well at any one time. Typically, one sub is deployed in each zone, but more than one can be deployed in a zone.

To treat a zone, an operator is able to operate a tool in a particular zone at a given point in time, while isolating that zone from other zones. This operation can be achieved by conveying a tool to a targeted sub within that zone. It can also involve, in the case of a tool that has already been preinstalled into a sub 16*a*-16*e* at a targeted zone, the timely conveyance of balls, darts or plugs that trigger, engage or support the operation of the preinstalled tool at the sub covering that zone.

SUMMARY

Embodiments of the invention are able to convey a tool to a specified one of a number of zones in a string, or alternatively, to be able to convey a plug that actuates a pre-installed tool located at a specified zone from a number of zones in a string.

This specification generally describes a completion system for conveying a tool to a target sub within a tubular string having a number of subs, with one or more subs being assigned to a zone. Each sub may include at least one ledge or shoulder in or on its interior surface that can be used as a latch stopper or stopper, for receiving and engagement with a latch. For example, the latch stopper may be a latch-stopping shoulder or a recess. The subs also have a latch deflector or deflector. The latch deflector may be for example a shoulder or a recess. In one embodiment, the latch deflector is a latch-deflection shoulder protruding into the internal diameter (ID) of the string for deflecting a latch, to be subsequently introduced, out of or into the latch-stopping shoulder. The distance between the latch stopper and the latch deflector, referred to as the "deflection radius," may be used as an address that uniquely identifies each sub, and can vary from sub to sub.

The completion system described herein also comprises a number of locating-and-lock mechanisms (referred to as a "lock") that are either attached to tools being conveyed downhole to a targeted sub, or are used to trigger one or more tool operations at a targeted sub, or trigger one or more operations cooperatively between the lock and the targeted sub. A lock is designed to be inserted (e.g., pumped, pushed, or dropped using gravity) into a string, and once inserted, to engage with only a subset of the subs in a string. The lock may include at least one latch which is shaped for landing on a latch-stopping shoulders on one or more subs, a latch pivot point around which the latch can pivot, be transposed, bend or otherwise move into or out of the path of a latch-stopping shoulder, and a latch-activation knob for interacting with a latch-deflection shoulder on a sub, to trigger pivoting or any other movement of the latch into or out of the path of a latch-stopping shoulder. The term "interacting" is a broad term used to describe interfacing, cooperation, interplay, and/or collaboration that may occur between two or more items such as a knob and a shoulder, when one of those items contacts the other item, or otherwise functionally associates with the other item using other force-generating sources such as magnetic fields and electric fields. All of the terms "interfacing", "cooperating", "interplaying", and/or "collaborating" are used interchangeably herein. The term "point" is a broad term used to describe a location, an area, a position, a spot, a place, etc. It is also noted that the pivot point may be provided on the tool or on the lock. The distance between the latch and latch-activation-knob, referred to as the "latch radius", is used to determine the sub with which a lock will engage, and can vary from lock to lock. In one embodiment, a lock may be targeted for engagement with a given sub by making the lock's latch radius less than or substantially equal to the sub's deflection radius, and by making its latch radius greater than the deflection radii of all subs it will encounter in the string before reaching a target sub. In this embodiment, a lock can avoid engaging any of the subs as it moves through the string, while its latch radius remains greater than the deflection radii of each of those subs. While the lock moves through the target sub, if its latch radius is less than or substantially equal to the target sub's deflection radius, an engagement can occur. In an alternate embodiment, a lock may be targeted for engagement with a given sub by making the lock's latch radius greater than the sub's deflection radius, and by making its latch radius substantially equal to or less than the deflection radii of all uphole subs it will encounter in the string before reaching the target sub. In this alternate embodiment, a lock can avoid engaging any of the subs it moves through while its latch radius remains less than or substantially equal to the deflection radii of each of those subs. When the lock enters the given targeted sub in this alternate embodiment however, its latch radius will be greater than that targeted sub's deflection radius, and engagement can occur. Accordingly, for both embodiments the latch radius of a lock can act as an address that enables the lock to traverse non target subs having certain deflection radii, and engage with a target sub having a certain other deflection radius.

It is also to be noted that preferably, a latch assembly comprises two or more locks; however, embodiments with one lock can also be used.

According to a broad aspect, the specification refers to an embodiment of a system for conveying a tool from surface to a target sub comprising: a string comprising a plurality of subs including the target sub, each sub having a latch deflector and a latch stopper, the latch deflector and the latch stopper together defining a deflection radius that is unique for each sub; and a lock mounted on the tool, having a knob capable of interaction with one or more of the latch deflectors, and a latch, the knob and the latch together defining a latch radius that is less than or substantially equal to the deflection radius of the target sub, wherein, the latch is deflectable away from the latch stopper of one or more of the plurality of subs whose deflection radius is less than the latch radius.

According to another embodiment, a system for conveying a tool from surface to a target sub comprises: a string comprising a plurality of subs including the target sub, each sub having a latch deflector and a latch stopper, the latch deflector and the latch stopper together defining a deflection radius that is unique for each sub, and a lock mounted on the tool, having a knob capable of interaction with one ore more of the latch deflectors, and a latch, the latch and the knob together defining a latch radius that is greater than the deflection radius of the target sub, wherein, the latch is deflectable towards the latch stopper of one or more of the subs whose deflection radius is less than the latch radius.

According to another embodiment, the specification provides a method of stopping a selected lock at a target sub, the sub comprising a latch deflector and a latch stopper that are separated by a first separation distance is also described according to another broad aspect described and illustrated. The method comprises: receiving a first lock, the first lock comprising a first knob and a first latch that are separated by a second separation distance, contacting the first knob with the latch deflector; allowing the first latch to traverse the latch stopper; receiving the selected lock, the selected lock comprising a second knob and a second latch; and stopping the selected lock by engaging the second latch with the latch stopper.

According to still another embodiment, the specification provides a method of moving a lock to a certain location in a string comprising an uphole sub and a downhole sub, the lock comprising a knob and a latch that are separated by a first separation distance, and the lock pivotable around a point. The method comprises: moving through the uphole sub, the sub comprising an uphole deflector and an uphole stopper that are separated by a second separation distance; pivoting around the point as a result of an interaction between the knob and the uphole deflector; traversing the uphole stopper; entering a downhole sub, the sub comprising a downhole deflector and a downhole stopper, and stopping on the downhole stopper.

Still further, the specification presents a lock assembly adapted to traverse a lock stopping assembly within a sub, comprising: a lock including: a latch provided at one end of the lock; a pivot point, enabling the latch to pivot or transpose between a postured-to-engage state and a postured-to-traverse state; and an activation knob separated by a latch radius from the latch, and adapted to deflect the latch from the postured-to-engage state to the postured-to-traverse state; and mounting gear for attaching the lock assembly to a tool, wherein the lock assembly is adapted to traverse the lock stopping assembly when the latch radius is greater than a deflection radius presented by the lock stopping assembly.

According to still another embodiment, the specification provides a lock assembly adapted to traverse a lock stopping assembly within a sub, comprising: a lock including: a latch provided at one end of the lock; a pivot point, enabling the latch to pivot or transpose between a postured-to-traverse state and a postured-to-engage state; and an activation knob separated by a latch radius from the latch, and adapted to deflect the latch from the postured-to-traverse state to the postured-to-engage state; and mounting gear for attaching the lock assembly to a tool, wherein the lock assembly is adapted to traverse the lock stopping assembly when the latch radius is less than or substantially equal to a deflection radius presented by the lock stopping assembly.

Still further, the specification describes a lock assembly adapted to engage with a lock stopping assembly within a sub, comprising: a lock including: a latch provided at one end of the lock; a pivot point, enabling the latch to pivot or transpose between a postured-to-traverse state and a postured-to-engage state; and an activation knob separated by a latch radius from the latch, and adapted to deflect the latch from the postured-to-engage state to the postured-to-traverse state; and mounting gear for attaching the lock assembly to a tool, wherein the lock assembly is adapted to engage the lock stopping assembly when the latch radius is less than or substantially equal to a deflection radius presented by the lock stopping assembly.

According to still another embodiment the specification describes a lock assembly adapted to engage with a lock stopping assembly within a sub, comprising: a lock including: a latch provided at one end of the lock; a pivot point, enabling the latch to pivot or transpose between a postured-to-traverse state and a postured-to-engage state; and an activation knob separated by a latch radius from the latch, and adapted to cause the latch to move from the postured-to-traverse state to the postured-to-engage state; and mounting gear for attaching the lock assembly to the tool, wherein the lock assembly is adapted to engage the lock stopping assembly when the latch radius is greater than a deflection radius presented by the lock stopping assembly.

It is to be understood that other aspects of the embodiments presented will become readily apparent to those skilled in the art from the following detailed description, wherein various embodiments are shown and described. The drawings and the detailed description should be regarded as illustrative in nature and are not restrictive.

BRIEF DESCRIPTION OF DRAWINGS

The drawings accompanying and forming part of this specification are included to depict certain aspects of embodiments of the invention. A clearer impression of embodiments of the invention, and of the components and operation of systems provided with embodiments of the invention, will become more readily apparent by referring to the exemplary, and therefore non-limiting, embodiments illustrated in the drawings, wherein identical reference numerals designate the same components. Note that the features illustrated in the drawings are not necessarily drawn to scale.

FIG. 2*a* illustrates diagrammatically a lock as it approaches a sub for disengagement; FIG. 2*b* illustrates diagrammatically an example of lock-to-sub engagement; FIGS. 2*c* and 2*d* illustrate the cross-section of the lock and sub when the latch radius is greater than the deflection radius; FIG. 2*e* illustrates the operation of the latch-activation knob, latch pivot point and latch-deflection shoulder of the embodiment of FIGS. 2*a* though 2*d* in more detail; and FIG. 2*f* illustrates the operation of the latch and latch-stopping shoulder of the embodiment of FIGS. 2*a* though 2*d* in greater detail.

FIG. 3*a* shows the lock as it approaches a latch-stopping shoulder and latch-deflection shoulder of a sub, and FIG. 3*b* shows a lock in engagement with the sub; FIG. 3*c* illustrates the operation of the latch-activation knob latch pivot point and latch-deflection shoulder of the embodiment of FIG. 3*a* and FIG. 3*b*, and FIG. 3*d* illustrates operation of the latch and the latch-stopping shoulder of the embodiment of FIG. 3*a* and FIG. 3*b* in greater detail.

DESCRIPTION OF THE PREFERRED EMBODIMENTS

This disclosure and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure the disclosure in detail. Skilled artisans should understand, however, that the detailed description and the specific examples, while disclosing preferred embodiments, are given by way of illustration only and not by way of limitation. Various substitutions, modifications, additions or rearrangements within the scope of the underlying inventive concept(s) will become apparent to those skilled in the art after reading this disclosure.

Figure 1:
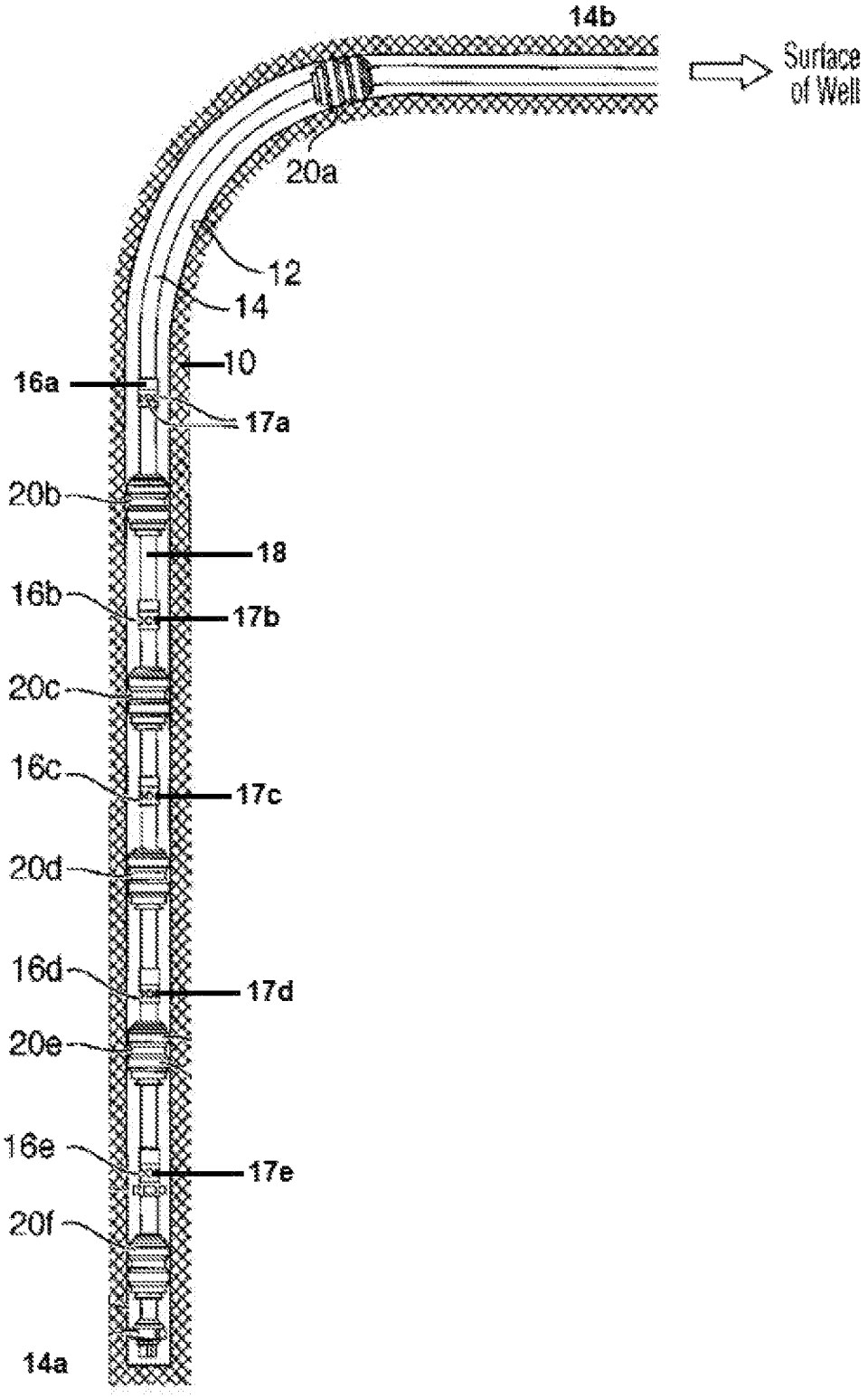
FIG. 1 is a diagrammatic representation of a schematic view through a wellbore with a tubing string installed therein.
Figure 1B:
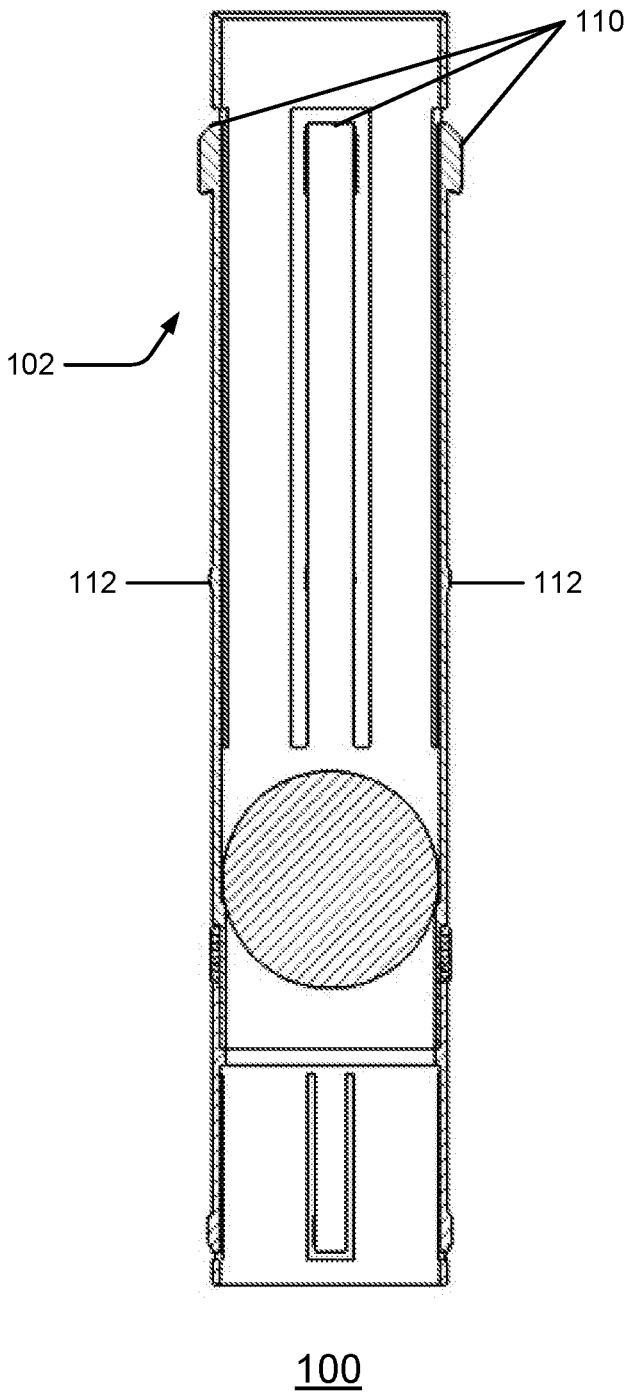
FIG. 1*b* is a schematic representation of a tubular-shaped tool having several locks arranged around its circumference.

FIG. 1*b* shows a tubular-shaped tool, such as a tool 100, having several locks 102 arranged around its circumference. Each lock comprises a latch 110, a latch pivot point 106 (not shown), and a latch-activation knob 112. Any lock 102 of FIG. 1*b*, alone or in combination with other locks 102, would be attached to a device or tool and inserted into a string comprising several subs, such as string 14 and several subs 16*a*-*e* of FIG. 1. The tool or sleeve 100 having several locks 102 for example, is inserted into the string 14 for engagement with a target sub from amongst the several subs 16*a*-*e*. Each sub has a latch stopper and a latch deflector (not shown in FIG. 1 or FIG. 1*b*), for potential engagement with the tool 100. Though the following description details the interaction between a single lock and a set of subs (one of which will be engaged by the lock), one skilled in the art will appreciate that a device, or other tool having preferably several identical locks could be inserted into the string, and that each lock will interact with the subs in much the same way as the individual lock described below. One skilled in the art will appreciate that the term "engage", "engaged" or "engaging", as used herein, means to latch, stop or hold In use, an operator may install a string comprising one or more subs, that each have for example a latch-stopping shoulder and a latch-deflection shoulder separated from each other by a deflection radius. When a target sub in the string is designated to host a tool, assuming that target sub is separated from surface by one or more other non-target uphole subs, a lock is selected that has a latch radius with the following characteristics: 1) in a first embodiment (hereinafter, also referenced as a "deflect-out-of-engagement" embodiment), the lock's latch radius is less than or substantially equal to the target sub's deflection radius, and greater than the deflection radius of each of the non-target uphole subs and 2) in an alternate embodiment (hereinafter, also referenced as a "deflect-into-engagement" embodiment), the lock's latch radius is greater than the target sub's deflection radius, and substantially equal to or less than the deflection radius of each of the non-target uphole subs. The lock is then inserted into the string, with its latch 1) in the first embodiment, postured to engage with the latch-stopping shoulder of a sub upon axial alignment of the latch and that sub's latch-stopping shoulder, and 2) in the alternate embodiment, postured to traverse the latch-stopping shoulder of a sub even upon axial alignment of the latch and the latch-stopping shoulder. As the lock proceeds downhole towards the latch-stopping shoulder of each non-target uphole sub, the lock's latch will not be stopped by any of those non-target latch-stopping shoulders since: 1) in the first embodiment, the latch is deflected away from each non-target sub's latch-stopping shoulder, as a result of interaction between the lock's knob and that sub's latch deflection shoulder, before the latch can engage the latch-stopping shoulder, and 2) in the alternate embodiment, by the time the latch is deflected towards the non-target sub's latch stopping shoulder, as a result of interaction between the lock's knob and that sub's latch deflection shoulder, the latch will have already traversed the latch stopping shoulder. When the lock reaches the target sub however, the latch will be stopped by the latch-stopping shoulder, and the lock will thus engage the targeted sub, since 1) in the first embodiment, the latch engages the target sub's latch-stopping shoulder before the latch can be deflected away from the latch-stopping shoulder as a result of interaction between its knob and the sub's latch deflection shoulder (i.e., since the latch radius is now less than or substantially equal to the deflection radius), and 2) in the alternate embodiment, the latch engages the target sub's latch-stopping shoulder when the latch is deflected towards a latch stopping shoulder as a result of interaction between its knob and the sub's latch deflection shoulder, before the latch has traversed the latch stopping shoulder (i.e., since the latch radius is now greater than the deflection radius of the target sub). One skilled in the art will appreciate that the term "substantially equal" accounts for the dimensional tolerances of the critical parts of the system, such as, but not limited to the pivot point, the latch and the deflection knob, all of which are subject to variations in machining or other manufacturing accuracies. Likewise, "substantially equal" also accounts for the precision of the required tolerances being a function of the number of locks inserted into the string.

One skilled in the art will appreciate that for certain embodiments described below, engagement between a lock and a sub occurs when the latch radius is substantially equal to, or less than, the deflection radius. The need for engagement between additional pairs of locks and subs having different latch and deflection radii may be a factor in determining the extent to which the latch radius is less than the deflection radius. Likewise, for certain other embodiments described below, engagement between a lock and a sub occurs when the latch radius is greater than the deflection radius. The need for engagement between additional pairs of locks and subs having different latch and deflection radii may be a factor in determining the extent to which the latch radius is greater than the deflection radius.

Upon engagement of the lock with the target sub, an optional seal can be established that isolates between the uphole and downhole sides of the lock, thus providing a system to allow for other operations to be performed at that sub, including but not limited to measuring down hole pressure/temperature, isolating a production zone, performing a pressure test, fracturing or otherwise stimulating a zone, installing a flow regulating device or moving a sliding sleeve to another position.

Furthermore, as part of the engagement process, one or more components may be moved or repositioned to further enhance the strength and sealing capabilities of the system. For example, after or during engagement, a C-Ring can be pushed onto a shoulder causing it to bridge the area between the latch and the sub and thus transferring the loads associated with a completion operation from the latch to the body of the lock, via the C-Ring and into the sub.

Figure 2A:
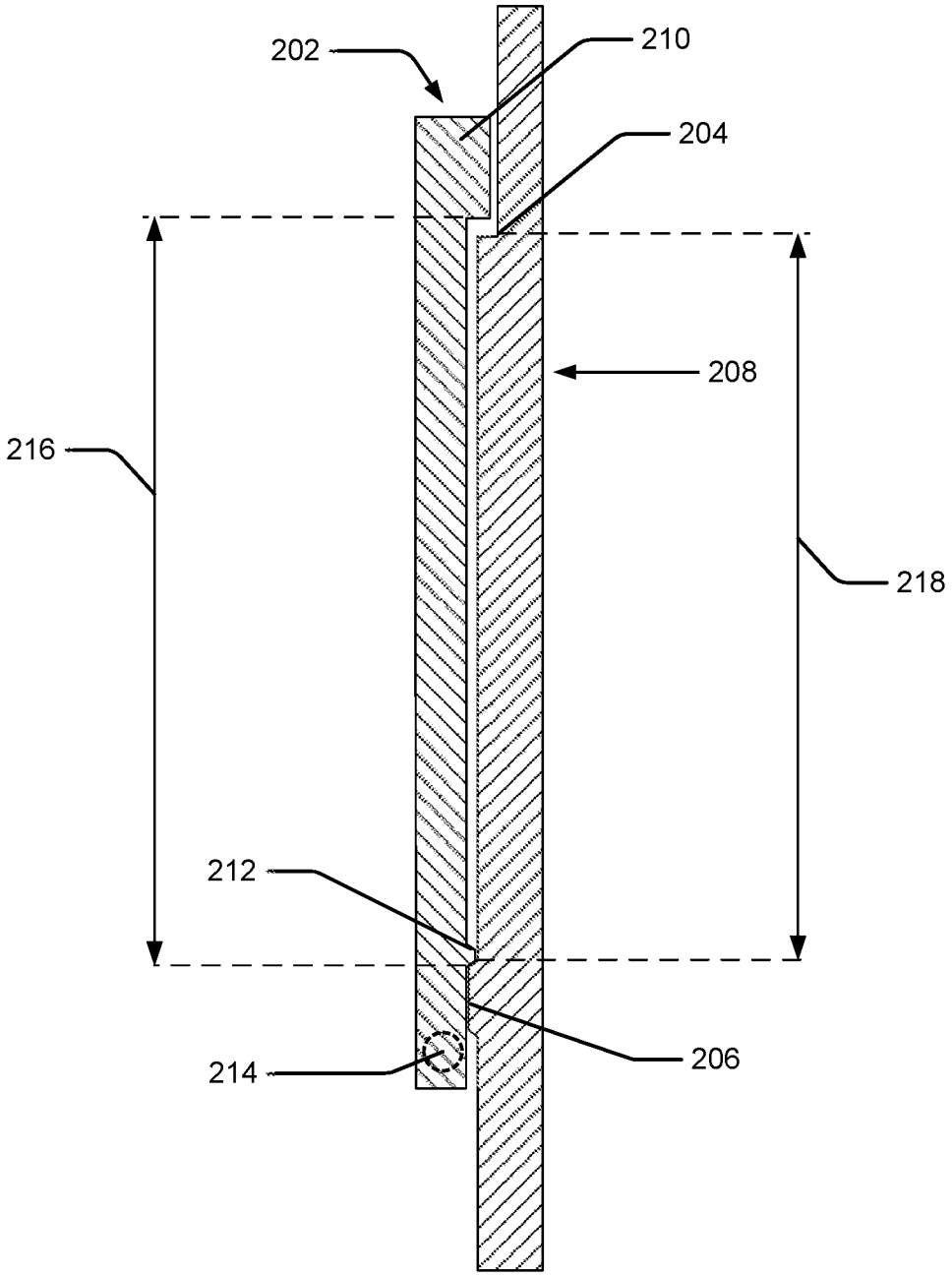
FIGS. 2*a*-2*f* show various views of an embodiment of a lock with the pivot point located downhole relative to the latch-activation knob. Thus.

FIG. 2*a* illustrates a cross-section of a single lock 202 as it approaches a latch-stopping shoulder 204 and latch-deflection shoulder 206 of a sub 208. As one example, element 208 in FIG. 2 may be a part of sub 16*a* illustrated in FIG. 1. Specifically, one or more locks, such as lock 102 from FIG. 1*b*, are mounted on a tool such as sleeve 100 from FIG. 1*b*. Each lock 102 comprises a latch 210, a latch-activation knob 212, and a latch pivot point 214 around which the latch can rotate. The latch 210 may be referred to as a "stop" or a "keeper" and is the part of the lock that engages with a targeted sub. The latch moves into or out of engagement with a sub by both axially moving inside a string, and as it axially moves inside a string, by radially pivoting around the latch pivot point 214. One skilled in the art will note that pivoting, rotating, bending and moving about a pivot have equivalent meanings and are thus all used interchangeably herein. The latch pivot point 214 may include, but is not limited to, a conventional hinge, a bendable plate, a cantilever, a collet, or a structure having two surfaces that rotationally interact with one another (i.e., a round or curved surface that rolls on a flat surface). The distance between the latch-activation knob 212 and the latch pivot point 214 can be varied and their axial orientation (i.e., with respect to uphole versus downhole) can be reversed. The distance between the latch 210 and the latch-activation knob 212 is defined as the latch radius 216. In the embodiment of FIG. 2*a*, the latch pivot point 214 is located downhole from the latch-activation knob 212. The sub 208 comprises the selectable latch-stopping shoulder 204 and the latch-deflection shoulder 206, and the distance between the latch-stopping shoulder 204 and the latch-deflection shoulder 206 is defined as the deflection radius 218.

Those skilled in the art will appreciate that the locks can be attached or mounted on a tool using a wide variety of ways, means, tools, objects, materials, mechanisms, purposes and methods (called "mounting gears"). These mounting gears can range from a simple hinge-pin to complex multi-point pivoting and flexing. For example, one may use a pin that extends from the lock or through the lock into the tool, mount the end of a lock on a tool using a cantilever where the lock is bending in a spring-like manner when the latch-activation knob is interacting with the latch-deflection shoulder. The lock can also be mounted using a shear mechanism such that when the latch is stopping on a latch-stopping shoulder, the lock is sheared off the tool and moved onto a ramp to enhance the strength of the lock and sub engagement. One skilled in the art will also appreciate that a hinge pin my perform a shear function in itself, and that one or more shoulders and grooves within the lock and tool can be used with springs, clips or c-rings to mount the lock to the tool. Furthermore, many of the mounting types can be used such that the lock is allowed not only to pivot, bend or cantilever, but to also move in other directions to compensate for, impact and/or allow for the lock to move into another position.

Figure 2B:
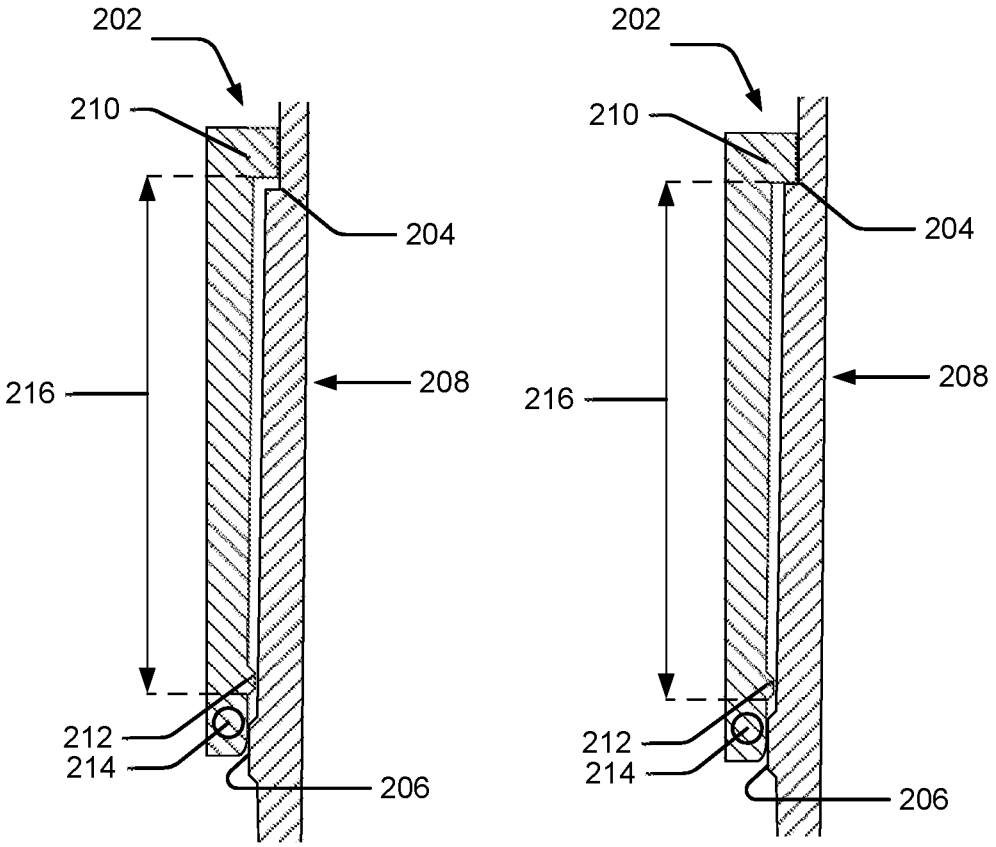

In different embodiments of this invention, the location of the lock's pivot point 214 can be varied to be either downhole or uphole relative to the latch-activation knob 212. In the embodiment illustrated in FIG. 2*a*, which corresponds to the previously referenced "deflect-out-of-engagement" configuration, the latch-activation knob 212 is located, as shown, above the latch pivot point 214, and each such lock 202 is moved through one or more subs with its latch 210 postured to engage with the latch-stopping shoulder 204 of a targeted sub 208, upon axial alignment of the latch 210 and the latch-stopping shoulder 204. When the lock 202 traverses a sub 208 whose deflection radius 218 is greater than or substantially equal to the lock's latch radius 216, the latch 210 is stopped by the latch-stopping shoulder 204 before there is interaction between the latch-activation knob 212 and latch-deflection shoulder 206 (i.e., before a deflection occurs that puts the lock into a non-engageable posture), resulting in a lock-to-sub engagement as shown in FIG. 2*b*. Because the latch radius 216 is less than or substantially equal to the deflection radius 208 in such a case, by the time the latch-activation knob 212 is approaching, or before substantially interacting with the latch-deflection shoulder 206, the latch 210 will have already been stopped by the latch-stopping shoulder 204 preventing any more downward movement of the lock relative to the sub 208. Such engagement would occur before sufficient interaction can occur between the latch-activation knob 212 and the latch-deflection shoulder 206. Thus, a lock can be latched and stopped in a sub.

Figure 2C:
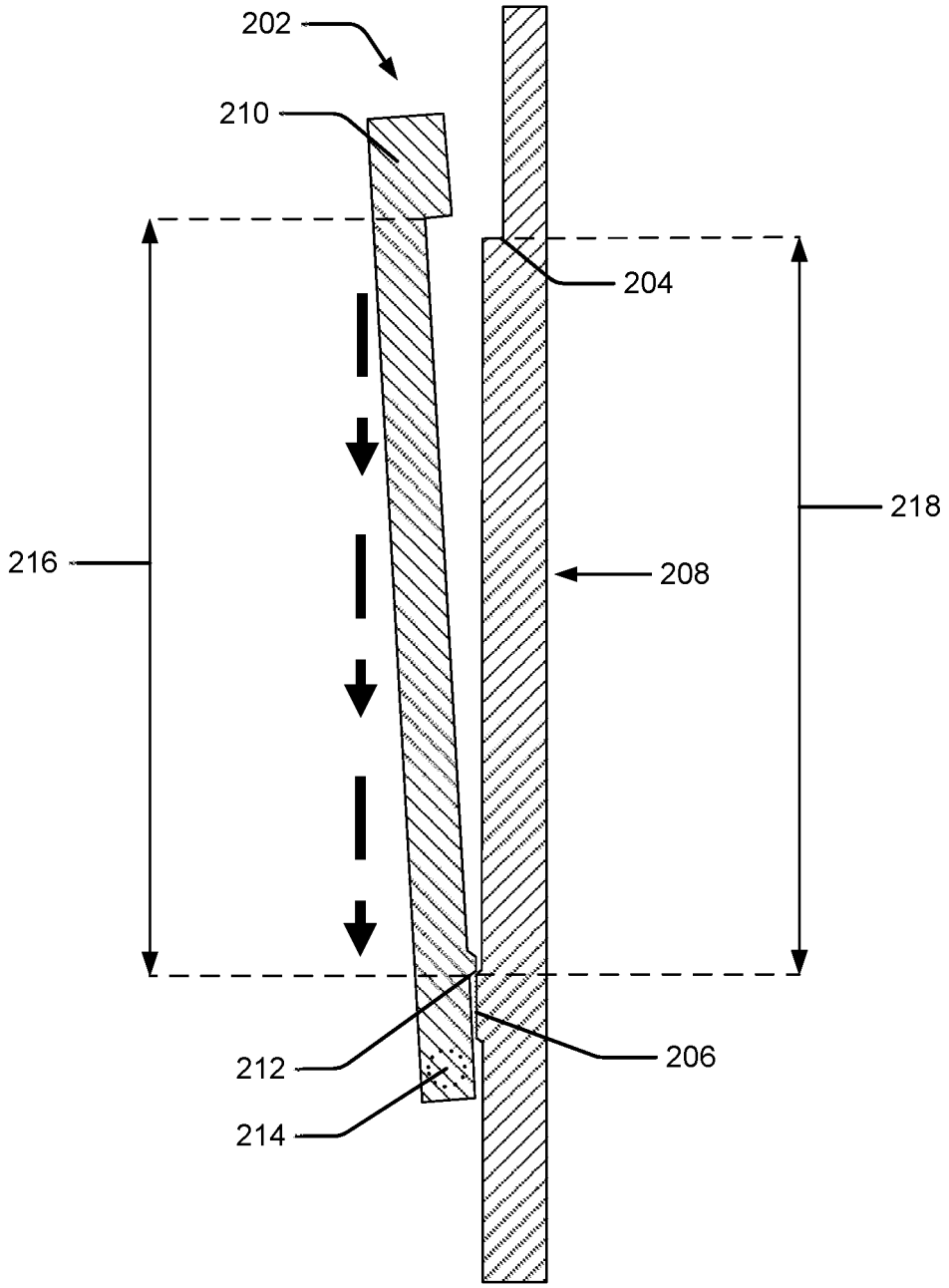
Figure 2D:
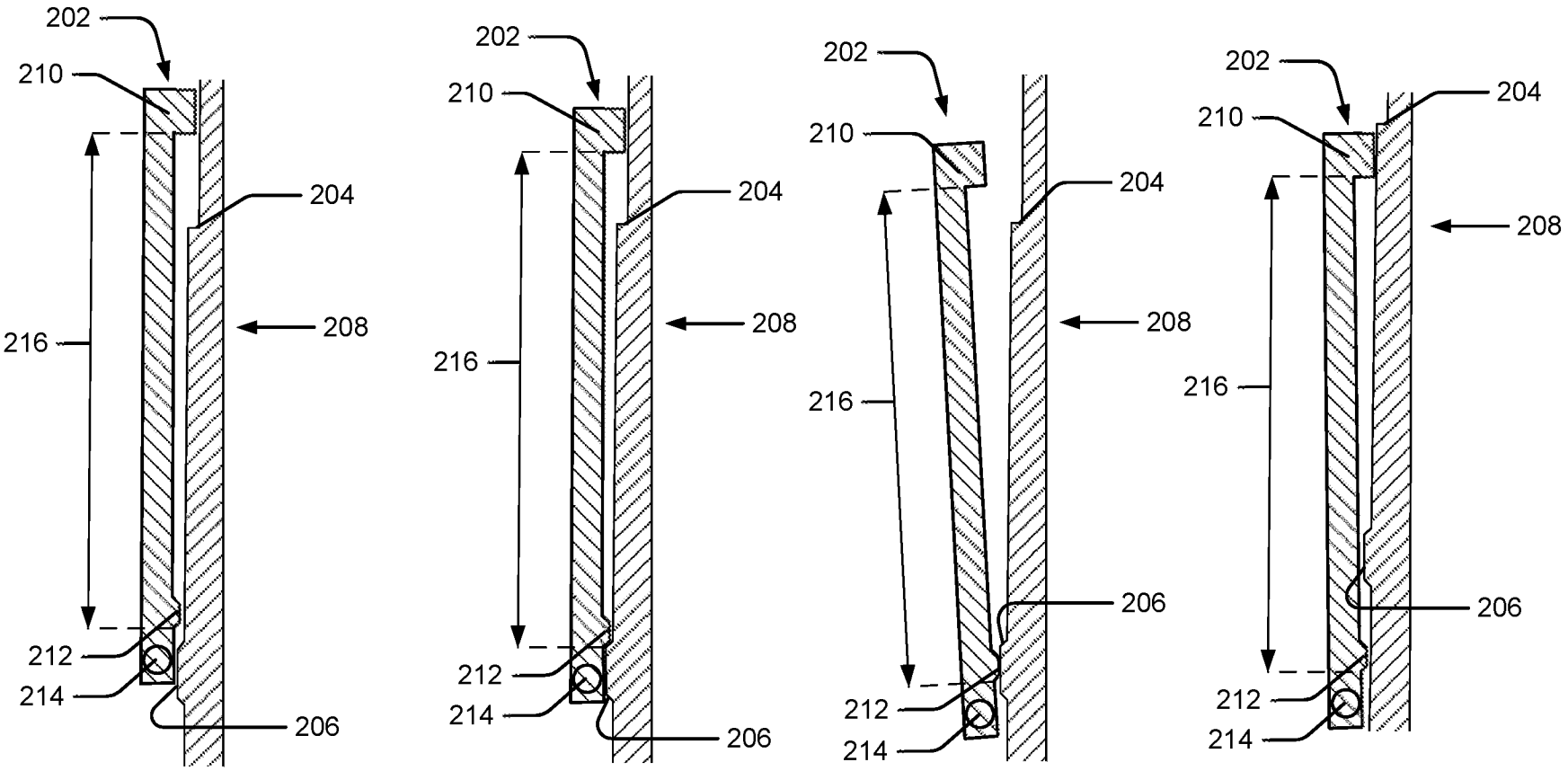

FIG. 2*c* and FIG. 2*d* illustrate the cross-section of the lock 202 and sub 208 when the latch radius 216 is greater than the deflection radius 218. In this case, once the latch-activation knob 212 starts interacting with the latch-deflection shoulder 206, more downward movement (illustrated by the dashed downward pointing arrows) of the lock 202 relative to the sub 208 will cause the latch 210 to be temporarily deflected away from the latch-stopping shoulder 204, before it can be stopped by the latch-stopping shoulder 204. Put another way, in this "deflect-out-of-engagement" configuration, when the latch radius 216 is greater than the deflection radius 218, the deflection of the latch away from the latch-stopping shoulder (i.e., that is triggered by interaction between the latch-activation knob 212 and the latch-deflection shoulder 206) occurs before the latch 210 is stopped by the latch-stopping shoulder 204. The latch 210 is temporarily deflected out of the engagement posture relative to the latch-stopping shoulder 204, upon interaction between the latch-activation knob 212 and latch-deflection shoulder 206 and downward movement of the lock 202 relative to the sub 208, and remains deflected until the latch 210 traverses the latch-stopping shoulder 204 as illustrated in FIG. 2*c* and FIG. 2*d*.

After traversing the sub 208, the latch 210 may be automatically moved into a ready-to-engage posture once again, prior to encountering the next latch-stopping shoulder 204 in the next sub downhole, through an energy source (not shown) within the lock 202 such as, but not limited to, a spring, c-ring or collet. This will ensure the deflection triggered by interaction between the lock's latch-activation knob 212 and the sub's latch-deflection shoulder 206 is temporary, and that the latch 210 is postured to be stopped by the next sub's latch-stopping shoulders upon their axial alignment. The lock 202 will thus continue moving downhole until a sub with a deflection radius that is greater than or substantially equal to the lock's latch radius 216 is encountered, as illustrated in FIG. 2*b*.

When a plurality of subs in a string need to be sequentially engaged by locks 202 using the embodiment of the invention illustrated in FIG. 2*a* through FIG. 2*d*, subs can be arranged in the string such that deflection radii 218 increase the further downhole the sub is located. Also, locks 202 are inserted into the string from surface such that latch radii 216 decrease with respect to sequence. Namely, assuming engagement first occurs at the most downhole sub and lastly occurs at the most uphole sub, the first lock sent into the string has the longest latch radius 316, and the last lock sent into the string has the shortest latch radius 316. Without this sequencing, uphole subs having long deflection radii might incorrectly and prematurely engage, with locks 202 that have substantially shorter latch radii 216 and that are intended for subs located further downhole. Those skilled in the art will appreciate that an operator may choose to engage a lock with a target sub in a string, without first engaging locks with all subs that are downhole from that target sub. For example, an operator may choose to engage a lock with the second most uphole sub of a string comprising five subs in total, without previously having engaged locks with any of the three other subs that are located further downhole. This is particularly useful if the system is used for completion operations such as installing a pressure gauge, or installing and/or operating a flow regulation device, where tools need not be inserted in a sequential series of subs.

Figure 2E:
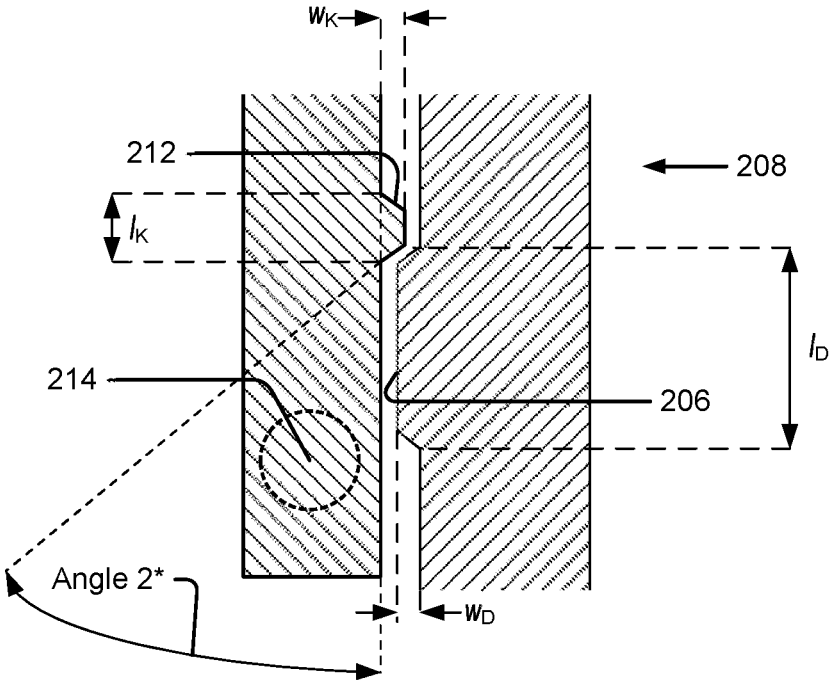

FIG. 2*e* illustrates the operation of the latch-activation knob 212, latch pivot point 214 and latch-deflection shoulder 206, of the embodiment of FIGS. 2*a* though 2*d*, in more detail. The length $L_K$ of the latch-activation knob 212 and the length $L_D$ of the latch-deflection shoulder 206 determine the duration of a deflection. The width $W_k$ of the latch-activation knob 212 and the width $W_D$ of the latch-deflection shoulder 206 determine the radial extent of deflection by the latch 210. The angle of contact of the latch-activation knob 212 and the latch-deflection shoulder 206 also contributes to the degree of deflection experienced by the latch as the lock axially moves past a sub. For example, with a 30-degree angle, 1/16" of downhole axial movement by the lock may be sufficient for the latch to avoid engagement with the latch-stopping shoulder, while with a 60-degree angle, 1/8" of downhole axial movement by the lock may be required to avoid engagement. Note that the angle of contact can be variable as the interaction occurs, if the surface of the latch-activation knob 212 and/or the latch deflection shoulder 206 are curved instead of straight. Varying the length, width, angle of contact and surface curvature parameters, along with the location of the latch pivot point 214 relative to the latch-activation knob 212, allows for many combinations, making the system extremely flexible. Control over all these variables allows for a flexible and highly precise control over the selectivity of the system for matching a lock 202 to a sub 208 and will therefore allow for a large number of unique combinations and stages. One skilled in the art will appreciate that the term "match" and/or "matching", as it relates to a lock engaging with a sub or vise versa, includes a lock and a sub having cooperative geometry that provides for engagement between the lock and the sub, and includes approximate matches that take into account the dimensional tolerances of the critical parts of the system, such as, but not limited to the pivot point, the latch and the deflection knob, all of which are subject to variations in machining or other manufacturing accuracies.

Figure 2F:
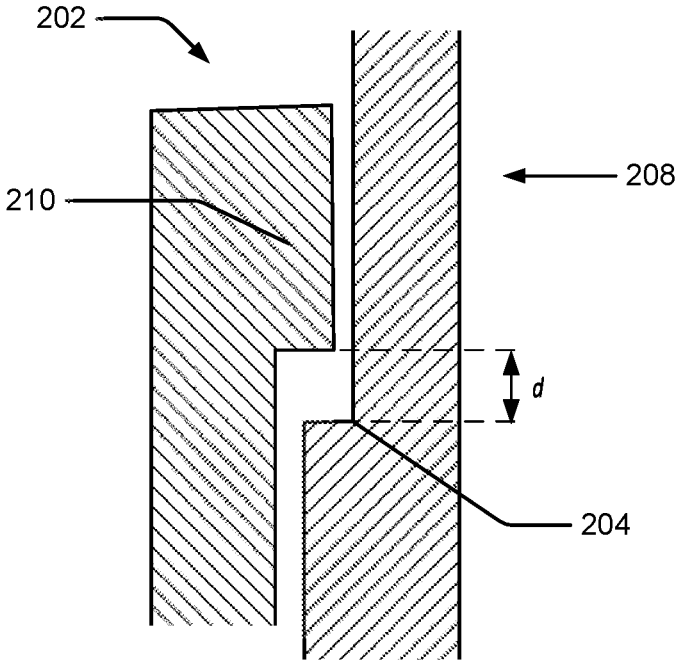

FIG. 2*f* illustrates the operation of the latch 210 and latch-stopping shoulder 204 of the embodiment of FIGS. 2*a* though 2*d* in greater detail. A disengagement distance "d" is defined as the downhole axial movement that the lock 202 must undergo for its latch to avoid engaging with the latch-stopping shoulder 204, once deflection of the latch 210 has commenced because of interaction between the latch-activation knob 212 and the latch-deflection shoulder 206. It should be noted that by adjusting parameters of the latch-activation knob 212 and latch-deflection shoulder 206, such as their lengths, widths and angles of contact, the disengagement distance "d" in this system can be as large or as small as desired. For example, the disengagement distance may be as small as ⅛ of an inch or less, allowing for precisely sized latch radii 216 and deflection radii 218. This in turn allows the system to support many zones while keeping the actual devices relatively short. This allows many tools to be installed and operated in a well. One skilled in the art, will appreciate that it is not always required for the engagement or disengagement distance to be short. For example, if only a relative small number of subs are installed, then the engagement distance can be extended to a value equal to or even greater than 0.5".

One skilled in the art will appreciate that for the embodiment of FIGS. 2*a* to 2*f*, engagement between a lock 202 and a sub 208 occurs when the latch radius 216 is less than or substantially equal to the deflection radius 218. In such a case, the need for engagement between additional pairs of locks and subs having different latch and deflection radii may be a factor in determining the extent to which the latch radius 216 is less than the deflection radius 218.

By using a direct mechanical mechanism to move the latch towards a deflect-out-of-engagement posture or to move the latch into a deflect-into-engagement posture, the lag time to prevent or establish engagement is reduced. As a result, the resulting latch disengagements or engagements (depending on whether a deflect-out-of-engagement embodiment or a deflect-into-engagement embodiment, is being used) are more accurate and reliable. The lock's ability to accurately and reliably engage or disengage with low lag time, will in turn, increase the degree of reliability and/or flexibility the system provides to the operator with conveying tools to certain subs of a string.

Moreover, since the engagement of a certain tool with a certain zone is not achieved by matching the shape of a latch 210 with the shape of some latch-mating profile, the latch 210 and latch-stopping shoulder 204 of the system described in this specification can be shaped to achieve objectives that are unrelated to creating a large number of tool-to-zone pairings (i.e., so as to increase zone count). Indeed, by using the aforementioned latching system, the latches 210 and latch-stopping shoulders 204 of the present system may be engineered to increase the strength of the lock-to-sub engagement, to reduce the debris-sensitivity of the entire conveyance system, and/or increase the inner diameter available for fluid flow through each sub.

Embodiments of the latching system also do not require the shape of the latch 210 and the shape of the latch-stopping shoulder 204 to be varied from zone to zone to allow for a large number of unique tool-to-zone pairings. Instead, latch 210 shapes may be uniform across all locks 202, and latch-stopping shoulder 204 shapes may be uniform across all subs. This uniformity makes it possible to create a single inner diameter (ID) string.

As can be seen from FIG. 2*a*, the "deflect-out-of-engagement" configuration is debris-tolerant since as the lock 202 is moved downhole through various subs 208, its latch 210 is oriented such that it would engage with an appropriately dimensioned latch-stopping shoulders 204 once the latch 210 and shoulder 204 are axially aligned, which makes it difficult for debris to significantly hinder the latching area. Also, by adding a minimal amount of space around the latch-stopping shoulder 204, debris is given room to move and stay significantly out of the way of the engagement areas of both the latch 210 and latch-stopping shoulder 204.

Figure 3A:
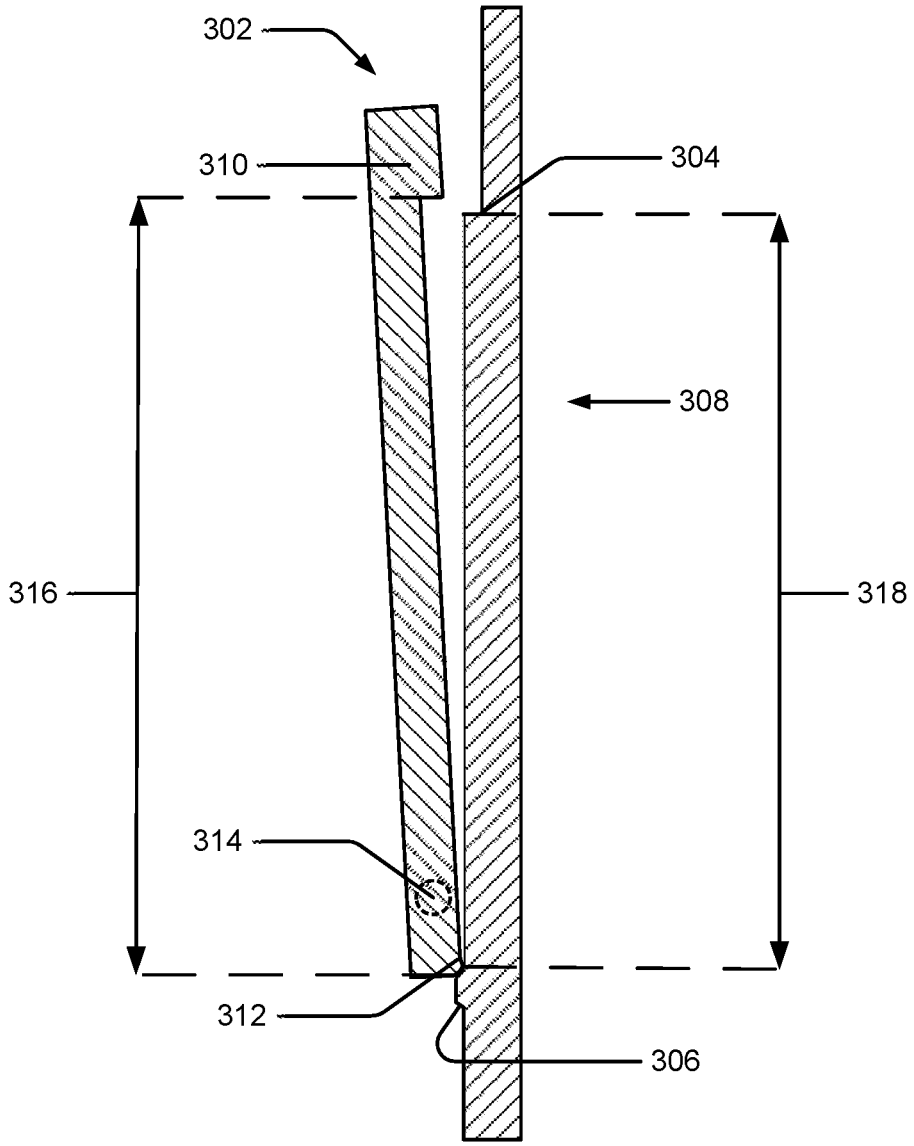
FIGS. 3*a*-3*d* illustrate an alternative embodiment of the lock, where the pivot point is located uphole relative to the latch-activation knob. Thus.

FIG. 3*a* shows an alternate embodiment of the system, which corresponds to the previously referenced "deflect-into-engagement" embodiment, and in which the pivot point 314 is located uphole relative to the latch-activation knob 312, unlike the embodiment of FIGS. 2*a* through FIG. 2*f*. The basic distance based activation/selectivity principle of this embodiment is similar to that of FIGS. 2*a* through FIG. 2*f*, in that engagement of a lock 302 to a sub 308 occurs only when the value of the latch radius 316 has a predefined relation as compared to the value of the deflection radius 318. This configuration however, effectively reverses the operation described with respect to FIGS. 2*a* through FIG. 2*f* in the following manner; specifically, in this embodiment, each lock 302 is moving through one or more subs 308 with its latch 310 postured to traverse the latch-stopping shoulder 304 of the subs 308, (even upon axial alignment of the latch 310 and the latch-stopping shoulder 304), unless the latch radius 316 is greater than the deflection radius 318. With this system, the latch 310 is in a ready-to-traverse posture until the latch-activation knob 312, located below the pivot point 314, is interacting with the latch-deflection shoulder 306, causing the latch 310 to move towards the latch-stopping shoulder 304 and into a posture that is ready for engagement with the latch-stopping shoulder 304.

Figure 3B:
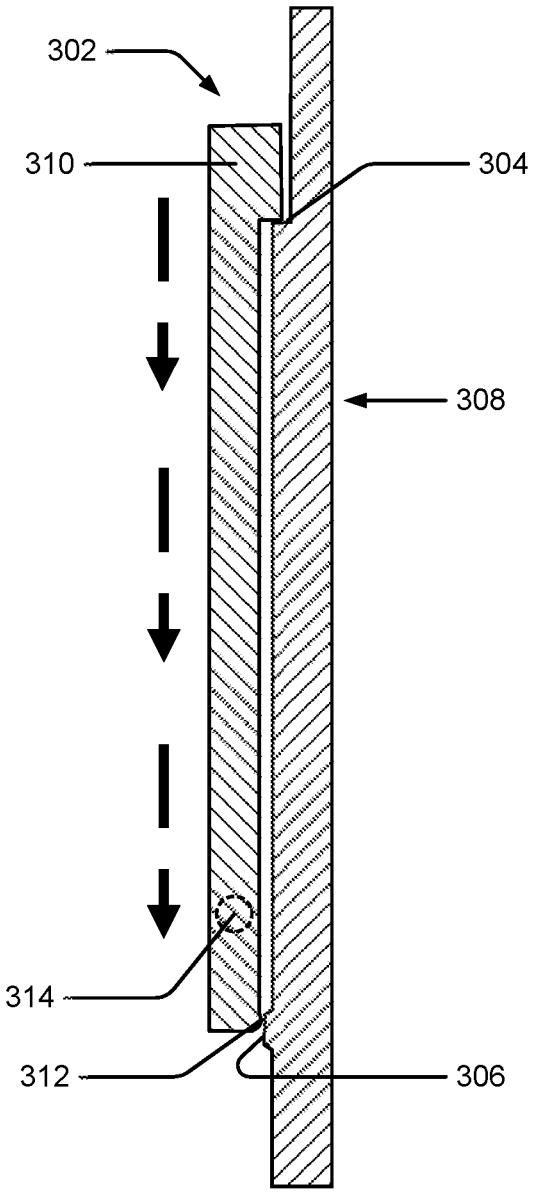

As shown in FIG. 3*b*, in the "deflect-into-engagement" configuration, when a lock 302 is traversing a sub 308 and the latch radius 316 is greater than the deflection radius 318, the latch 310 is moved into an engagement posture relative to the latch-stopping shoulder 304 upon interaction between the latch-activation knob 312 and latch-deflection shoulder 306, and the latch 310 engages with the latch-stopping shoulder 304 before the lock 302 can move any further downhole, resulting in a lock-to-sub engagement. Accordingly, in this embodiment, there is an engagement distance rather than a disengagement distance, between the latch 310 and the latch-stopping shoulder 304, as will be further explained below.

Specifically, as shown in FIG. 3*b*, when the latch-deflection shoulder 306 interact with the latch-activation knob 312, the latch 310 is deflected towards the latch-stopping shoulder 304 causing the latch 310 to engage with the latch-stopping shoulder 304. FIG. 3*b* shows the latch 310 and latch-stopping shoulder 304 in the engaged state. When the lock 302 approaches a sub 308 having a deflection radius 318 that is longer than its latch radius 316, the lock 302 continues to traverse the sub 308 in a ready-to-traverse posture relative to the latch-stopping shoulder 304 of the sub 308, and proceeds down hole to the next sub.

Unlike the embodiment of FIG. 2*a* through FIG. 2*f*, in the embodiment illustrated in FIG. 3*a* and FIG. 3*b*, when a plurality of subs in a string need to be sequentially engaged by locks, the subs need to be arranged in the string such that the deflection radii 318 decrease the further downhole the sub is located. Also, locks 302 need to be correspondingly inserted into the string from surface such that latch radii 316 increase with respect to sequence. Namely, assuming engagement first occurs at the most downhole sub and lastly occurs at the most uphole sub, the first lock sent into the string has the shortest latch radius 316, and the last lock sent into the string has the longest latch radius. Without this sequencing, uphole subs having short deflection radii may prematurely engage with locks 302 having longer latch radii 316 and that are intended for subs located further downhole. Those skilled in the art will appreciate that it is possible to make this deflect-into-engagement embodiment even more flexible, by adding more latch-deflection shoulders within the sub. For example, one may want to use the lock's latch as a hammer to create a detectable signal to provide feedback to the operator as to the relative position of the lock within the string, or one may like to activate a feature within or attached to a sub while traversing that sub.

Figure 3C:
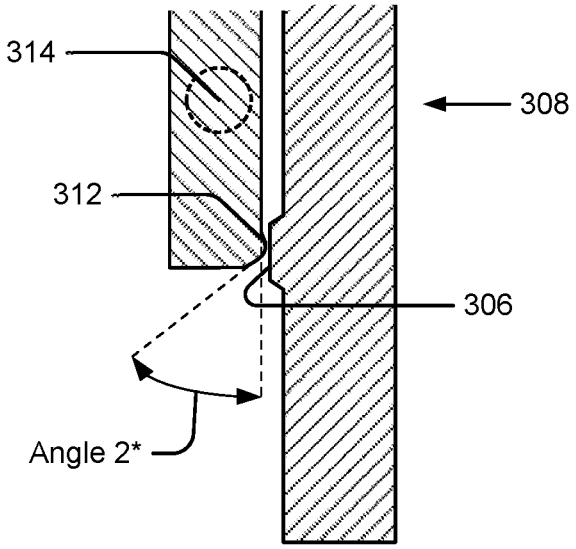

FIG. 3*c* illustrates the operation of the latch-activation knob 312, latch pivot point 314 and latch-deflection shoulder 306, of the embodiment of FIG. 3*a* and FIG. 3*b*, in more detail. As with the embodiment of FIG. 2*a* through FIG. 2*f*, the length of the latch-activation knob 312 and the length of the latch-deflection shoulder 306 determine the duration of a deflection in this embodiment. The width of the latch-activation knob 312 and the width of the latch-deflection shoulder 306 determine the radial extent of deflection by the latch 310. The angle of contact of the latch-activation knob 312 and the latch-deflection shoulder 306 also contributes to the degree of deflection experienced by the latch as the lock axially moves past a sub. For example, with a 30-degree angle, 1/16" of downhole axial movement by the lock could be sufficient for the latch to engage with the latch-stopping shoulder, while with a 60-degree angle, 1/8" of downhole axial movement by the lock could be required for engagement. Note that the angle of contact can be variable as the engagement occurs, if the surfaces of the latch-activation knob 212 and/or the latch deflection shoulder 206 are curved instead of straight.

Varying these length, width and angle parameters, along with the location of the latch pivot point 314 relative to the latch-activation knob 312, allows for many combinations making the system extremely flexible. Control over all these variables allows for a flexible and highly precise control over the selectivity of the system for matching a lock 302 to a sub 308. It also allows for several novel applications of the system, such as in the case of a "deflect-into-engagement" embodiment like the one of FIG. 3*a* and FIG. 3*b*, punching a disk or scratching a coating to allow wellbore fluids to access and activate degradable materials, which can be achieved by setting the variables to maximize the force with which latching occurs.

Figure 3D:
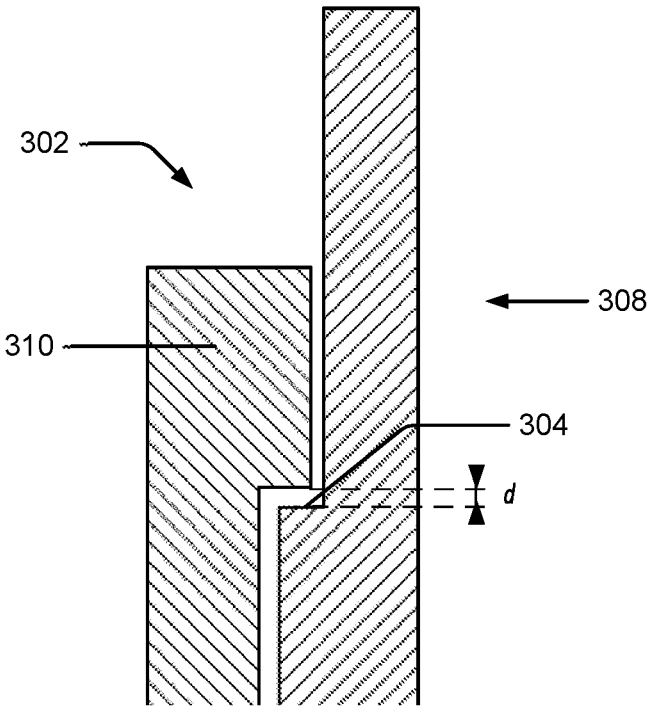

FIG. 3*d* illustrates the operation of the latch 310 and the latch-stopping shoulder 304 of the embodiment of FIG. 3*a* and FIG. 3*b* in greater detail. In this embodiment however, there is no disengagement distance, but rather an engagement distance. This engagement distance is the downhole axial movement that the lock 302 must undergo to move the latch 304 from the disengaged position to the ready to engage position, once deflection of the latch 310 has commenced because of interaction between the latch-activation knob 312 and the latch-deflection shoulder 306. Note that by adjusting parameters of the latch-activation knob 312 and latch-deflection shoulder 306, such as their lengths, widths and angles of contact, the engagement distance "d" shown in FIG. 3*d* in this system may be as large or as small as desired. For example, the engagement distance may be as small as 1/8 of an inch or less, allowing for precisely sized latch radii 316 and deflection radii 318. This in turn allows the system to support many zones while keeping the actual devices relatively short. This allows many tools to be installed and operated in a well.

One skilled in the art will appreciate that for the embodiment of FIGS. 3*a* to 3*d*, engagement between a lock 302 and a sub 308 occurs when the latch radius 316 is greater than the deflection radius 318. In such cases, the need for engagement between additional pairs of locks and subs having different latch and deflection radii may be a factor in determining the extent to which the latch radius 316 is greater than the deflection radius 318.

Benefits of the "deflect-into-engagement" embodiment of FIG. 3*a* through 3*d* include the latch 310 being protected while moving downhole towards a target sub 308. In the "deflect-into-engagement" configuration of FIG. 3*a* through FIG. 3*d*, the latch 310 is tucked away within the tool that contains the lock, and away from the inner wall of the string and subs it traverses, as it moves downhole.

A "deflect-into-engagement" embodiment like the one shown in FIGS. 3*a* through 3*d* may enable stronger latching forces. Specifically, in this embodiment, a latch 310 is orientated relative to a latch-stopping shoulder 304 such that it can be driven into the latch-stopping shoulder 304 with a great deal of force by varying the mechanical moment of the latch 310 for example. Stronger latching forces especially if combined with other mechanisms, can be used to achieve several objectives, including but not limited to crushing cement, scraping and cleaning other subs, or piercing through a rupture device or the tubular wall.

In all embodiments disclosed herein, each sub in a string could have substantially the same implementation of latch stopping shoulders and latch deflection shoulders (i.e., shape and size of shoulders), and thus each sub can have the same internal diameter, which can remain relatively large in downhole as well as in uphole subs, even while each being able to engage with differing locks having differing latch radii. Because the internal diameters can remain the same from sub to sub, the lock can then not only be conveyed into the well using a cable or coiled tubing, but can also be dropped, pumped or otherwise lowered into the well to locate its targeted latch-stopping shoulder in a target sub without the need for depth control. One skilled in the art will appreciate that an operator may install multiple sets of subs, with each set having a slightly different internal diameter. For example, one may install a first set of 20 subs each with a same first internal diameter, then one may install a second set of 15 subs uphole from the first set, the second set all having a same second internal diameter, the second internal diameter slightly larger than the first internal diameter. This will provide even greater flexibility to the system including enabling a much higher stage count.

Embodiments are also disclosed that feature compound latching actions within a single lock-to-sub engagement, in which the engagement of one latch with a latch-stopping shoulder automatically triggers one or more other engagements of other latches with other latch-stopping shoulders within the same sub. These multi-latch, multi-pivot, embodiments may be created by implementing combinations of the two different systems from FIG. 2*a* through 2*f*, and FIG. 3*a* through 3*d*, and provide even greater flexibility.

Such compound latching actions allow an initial latching action that is calibrated to optimize lock-location accuracy, to trigger one or more follow-on latching actions that are calibrated to optimize lock-to-sub gripping strength, which can be important where high treatment forces are to be applied to the lock and sub. A latching action that is part of a compound latching action can be calibrated to increase the latching force with which a lock engages a sub, which as mentioned above, can be used to achieve several important objectives.

In another embodiment of the system disclosed herein, the engagement roles of the lock and the sub can be reversed, such that the latch-deflection shoulder and latch-stopping shoulder can be installed on a lock that is inserted into the string, while the latch, latch-activation knob, and latch pivot point can be installed on various subs comprising that string. Put another way, in other embodiments of this invention, the sub can have a latch, a latch-activation knob and a latch pivot point, while a lock can have a latch-stopping shoulder and a latch-deflection shoulder.

In another embodiment, the latch-activation knob can be deflected away from the center line of the string and into a recess inside the interior surface of the sub.

In another embodiment, the lock or parts thereof can be made of a degradable material. In still another embodiment, the lock can be mounted on a device that can contains a degradable core. Such embodiments mean that the lock and the device on which it is mounted can become hollow overtime, thus allowing production or injection without the need of any milling operations.

In another embodiment, the lock may be designed to allow fluid to flow through its center, in order to allow operations such as the choking of a flow, or the hanging of a sand control device such as a well screen.

Although the invention has been described with respect to specific embodiments thereof, these embodiments are merely illustrative, and not restrictive of the invention. Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention Reference throughout this specification to "one embodiment", "an embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

As used herein, the terms "comprises," "comprising," "includes," "including," "has," "having," or any other variation thereof, are intended to cover a non-exclusive inclusion. For example, a process, product, article, or apparatus that comprises a list of elements is not necessarily limited only those elements but may include other elements not expressly listed or inherent to such process, product, article, or apparatus.

Furthermore, the term "or" as used herein is generally intended to mean "and/or" unless otherwise indicated. For example, a condition A or B is satisfied by any one of the following: A is true (or present) and B is false (or not present), A is false (or not present) and B is true (or present), and both A and B are true (or present). As used herein, a term preceded by "a" or "an" (and "the" when antecedent basis is "a" or "an") includes both singular and plural of such term, unless clearly indicated otherwise (i.e., that the reference "a" or "an" clearly indicates only the singular or only the plural). Also, as used in the description herein, the meaning of "in" includes "in" and "on" unless the context clearly dictates otherwise.

The invention claimed is:

1. A system for conveying a tool from surface to a target sub comprising:

a string comprising a plurality of subs including the target sub, each sub having a latch deflector and a latch stopper, the latch deflector and the latch stopper together define a deflection radius for each sub; and a lock mounted on the tool having a knob located downhole, a latch located uphole, and a pivot point that enables the latch to transpose between a postured-to-engage state and a postured-to-traverse state, wherein the knob and the latch together define a latch radius that is less than or substantially equal to the deflection radius of the target sub, wherein the pivot point is located downhole from the knob;

wherein the latch is configured to traverse the latch stopper of at least one sub of the plurality of subs as a result of the deflection radius of the at least one sub being less than the latch radius of the lock;

wherein the latch is configured to engage the latch stopper of the target sub as a result of the deflection radius of the at least one sub being greater than or substantially equal to the latch radius of the lock.

2. The system of claim 1 wherein the deflection radius of each sub between surface and the target sub, is less than the latch radius.

3. The system of claim 1 wherein the latch is configured for deflection having a transverse component that is centered around the pivot point on the lock.

4. The system of claim 1 wherein the subs are arranged in the string such that the deflection radii increase the further downhole the sub is located.

5. The system of claim 1, wherein the latch is configured to be deflected away from the latch stopper of one or more of the plurality of subs whose deflection radius is less than the latch radius as result of an interaction between the knob and the latch deflector, and is configured to be deflected back to a posture assumed before the interaction between the knob and the latch deflector, when the interaction ends.

6. The system of claim 1, wherein a duration of a deflection of the latch is selected to enable the latch to traverse the latch stopper.

7. The system of claim 1, wherein the lock includes two or more locks mounted on the tool.

8. The system of claim 1, wherein the tool comprises a plug.

9. The system of claim 8, wherein the plug is made of meltable, degradable, disintegrable, removable, or otherwise disappearing material.

10. The system of claim 1, wherein the latch is configured for deflection having an axial component and a lateral component perpendicular to the axial component.

11. The system of claim 1, wherein a duration of a deflection of the latch is determined by a length of the knob and a length of the latch deflector.

12. The system of claim 1, wherein an extent of a deflection of the latch is determined in part by a width of the knob, a width of the latch deflector, and a distance between the latch and the pivot point.

13. The system of claim 1, wherein an extent of a deflection of the latch is determined in part by an angle of contact between the knob and the latch deflector, and a distance between the latch and the pivot point.

* * * * *